US006237555B1

(12) United States Patent
Dykstra et al.

(10) Patent No.: US 6,237,555 B1
(45) Date of Patent: May 29, 2001

(54) SPARK BLANKING APPARATUS FOR AN INTERNAL COMBUSTION ENGINE

(75) Inventors: Richard A. Dykstra, Cedar Grove; Robert K. Mitchell, Brookfield; Gary J. Gracyalny, Milwaukee, all of WI (US)

(73) Assignee: Briggs & Stratton Corporation, Milwaukee, WI (US)

( * ) Notice: Subject to any disclaimer, the term of this patent is extended or adjusted under 35 U.S.C. 154(b) by 0 days.

(21) Appl. No.: 09/645,976

(22) Filed: Sep. 29, 2000

Related U.S. Application Data

(63) Continuation of application No. 09/358,326, filed on Jul. 21, 1999, now abandoned.

(51) Int. Cl.[7] ..... F02P 7/063

(52) U.S. Cl. ..... 123/146.5 A; 123/182.1; 123/198 DC

(58) Field of Search ..... 123/146.5 A, 146.5 R, 123/152, 153, 198 DC, 182.1

(56) References Cited

U.S. PATENT DOCUMENTS

| | | | |
|---|---|---|---|
| 430,505 | 6/1890 | Barrett et al. | 123/146.5 A |
| 583,586 | 6/1897 | Westinghouse et al. . | |
| 635,506 | 10/1899 | Olds . | |
| 698,405 | 4/1902 | Lambert . | |
| 700,401 | 5/1902 | Beilfuss . | |
| 709,598 | 9/1902 | Gray . | |
| 710,647 | 10/1902 | Witry . | |
| 737,202 | 8/1903 | Brooks . | |
| 768,687 | 8/1904 | Phelps . | |
| 788,595 | 5/1905 | Podlesak . | |
| 798,702 | 9/1905 | Rennell . | |
| 819,116 | 5/1906 | Austin . | |
| 826,253 | 7/1906 | Jeffrey . | |
| 845,354 | 2/1907 | Hildebrandt . | |
| 852,557 | 5/1907 | Harrington . | |
| 888,196 | 5/1908 | Ruud et al. . | |
| 898,974 | 9/1908 | Daniel . | |
| 918,286 | 4/1909 | Cramer . | |
| 924,639 | 6/1909 | Cramer . | |
| 934,978 | 9/1909 | Marks | 123/146.5 A X |
| 946,816 | 1/1910 | Bates . | |
| 976,478 | 11/1910 | Londick . | |
| 1,048,302 | 12/1912 | Dominguez . | |
| 1,082,402 | 12/1913 | Campbell . | |
| 1,099,249 | 6/1914 | Holm . | |
| 1,204,573 | 11/1916 | Kane . | |
| 1,679,220 | 7/1928 | Jahnke . | |
| 1,798,712 | 3/1931 | Viramontes | 123/146.5 A |
| 3,812,305 | 5/1974 | Rees | 200/284 |
| 5,150,674 | 9/1992 | Gracyalny | 123/182.1 |
| 5,167,214 | 12/1992 | deRonde | 123/617 |
| 5,197,422 | 3/1993 | Olesky et al. | 123/182.1 |
| 5,219,397 | 6/1993 | Jones | 123/179.3 |

FOREIGN PATENT DOCUMENTS

| | | |
|---|---|---|
| 3939067 | 5/1991 | (DE) . |
| 0 853 189 | 7/1998 | (EP) . |
| 10037782 | 2/1998 | (JP) . |

*Primary Examiner*—Tony M. Argenbright
(74) *Attorney, Agent, or Firm*—Michael Best & Friedrich LLP

(57) ABSTRACT

A spark prevention apparatus during the exhaust stroke of a four-stroke-cycle internal combustion engine is claimed. A valve operating assembly operates an intake or an exhaust valve. A switch is electrically connected to a primary winding of the engine and actuated by the valve operating assembly such that either the primary winding is electrically connected to ground during the exhaust stroke or the primary winding is electrically connected to an energy storage device during the exhaust stroke.

21 Claims, 5 Drawing Sheets

FIG. 1
PRIOR ART
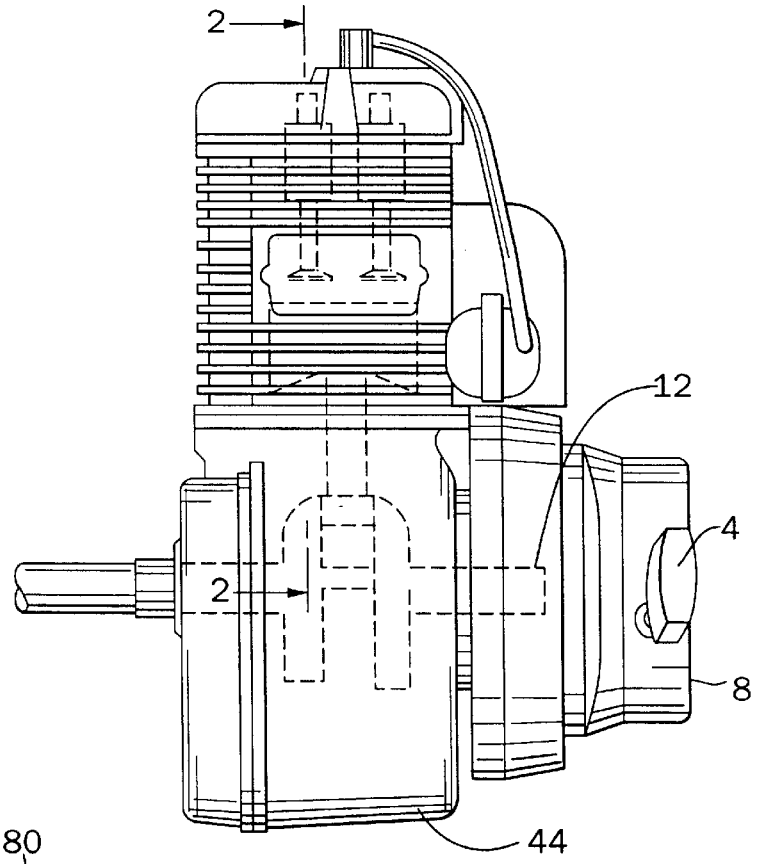
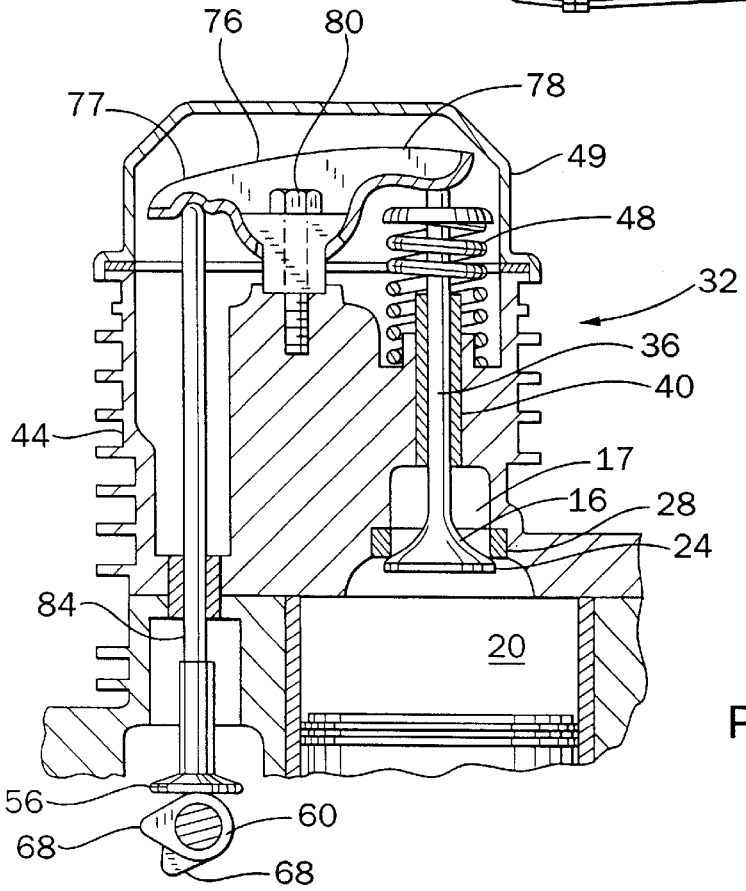
FIG. 2
PRIOR ART

FIG. 7
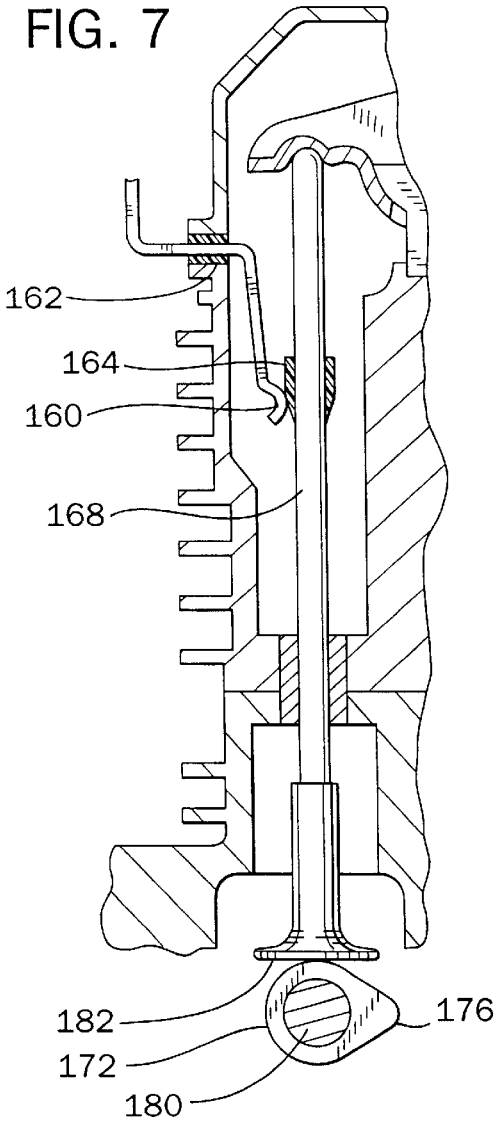
FIG. 8
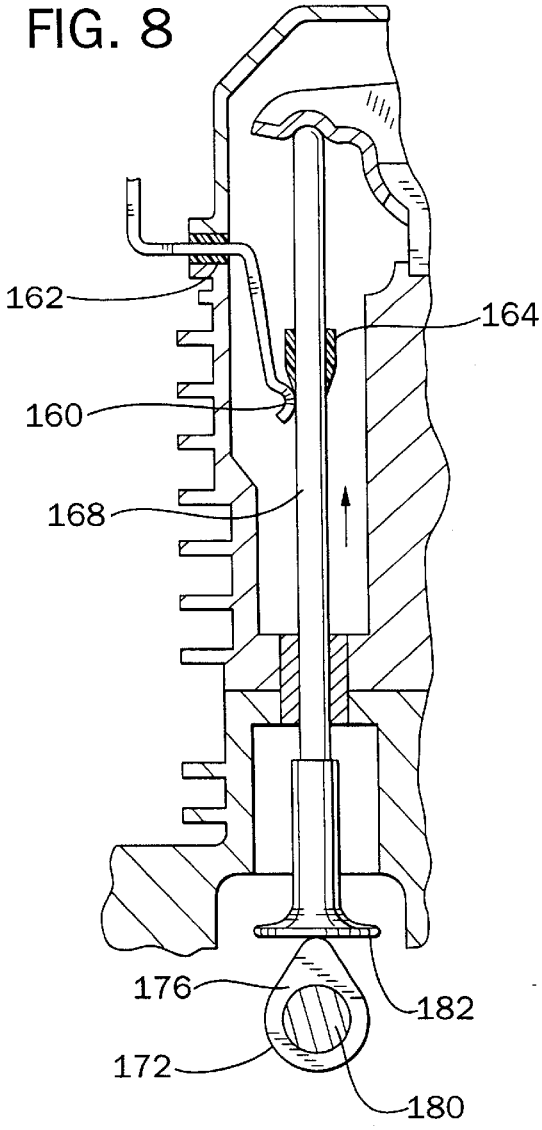
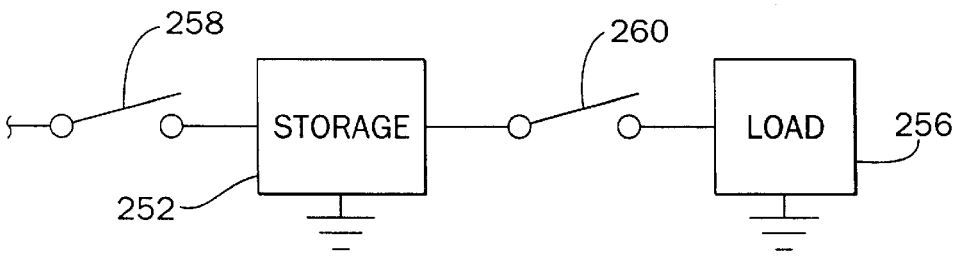
FIG. 12
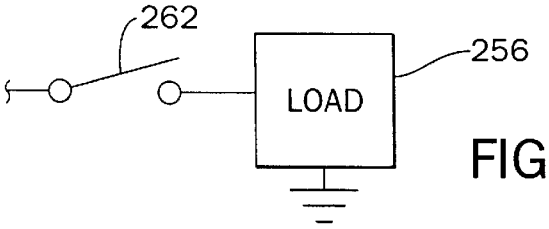
FIG. 13

FIG. 9
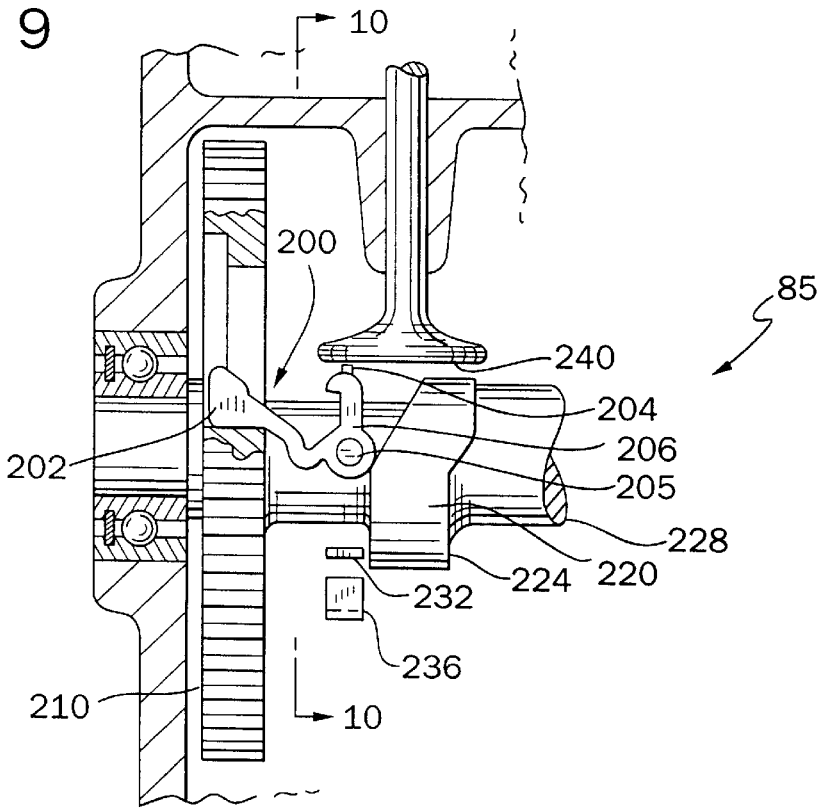
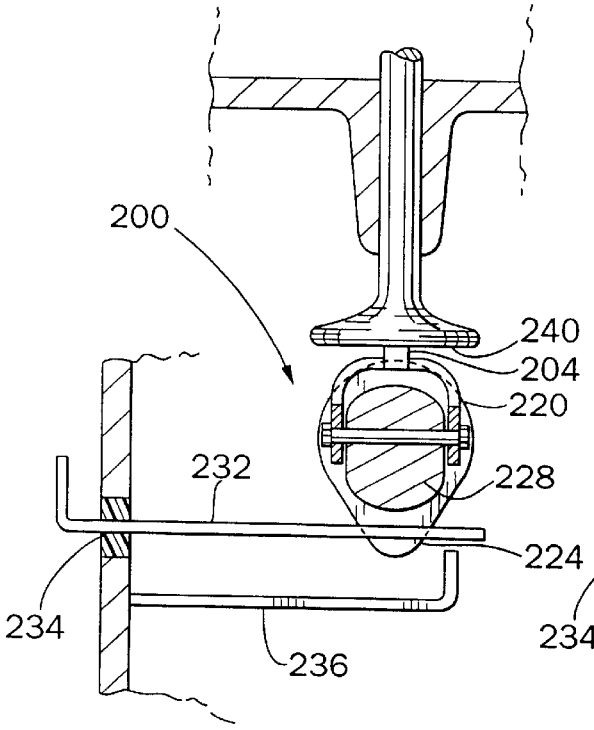
FIG. 10
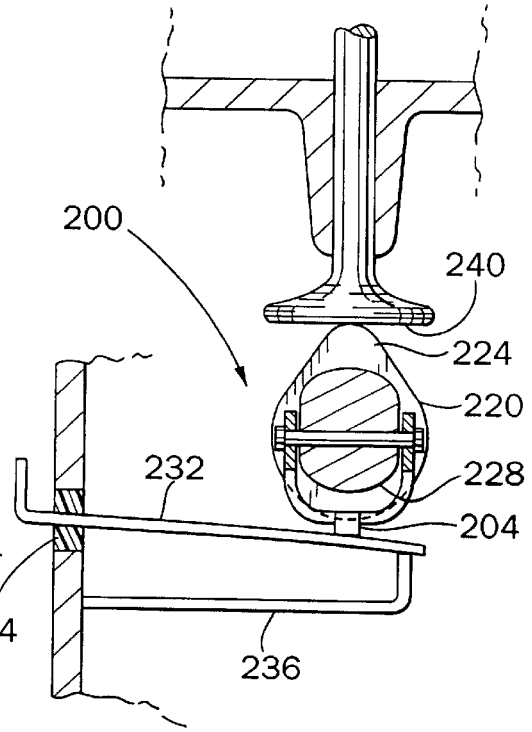
FIG. 11

SPARK BLANKING APPARATUS FOR AN INTERNAL COMBUSTION ENGINE

This patent application is a continuation of application Ser. No. 09/358,326, filed Jul. 21, 1999, now abandoned.

BACKGROUND OF THE INVENTION

The present invention relates to internal combustion engines, and more particularly to suppressing an electrical spark during the exhaust stroke of a four-stroke small internal combustion engine, for use in generators, lawnmowers and other lawn and garden equipment and the like.

A four-stroke reciprocating engine has four strokes of the piston and two revolutions of the crankshaft for each engine cycle. The first stroke, or the intake cycle, occurs as the piston moves downward, creating a partial vacuum in the cylinder. In the intake stroke, the intake valve opens, allowing an air and fuel mixture to enter the cylinder. The second stroke, or the compression stroke, compresses the air and fuel mixture as the piston moves upward. At the end of the compression stroke, the spark plug is fired to ignite the air and fuel mixture typically just before the piston reaches top dead center. The third stroke is the power stroke or expansion stroke. In the power stroke, the air and fuel mixture burns and expands, forcing the piston downward. The fourth stroke, or the exhaust stroke, forces burned gases out of the cylinder through the open exhaust valve as the piston moves upward.

Small 4-stroke, spark ignition internal combustion engines often use either an inductive-magneto or capacitor-discharge ignition system that generates a spark plug arc during each engine flywheel revolution. The spark plug arc generated near the end of an engine's compression stroke is used to generate engine power, while the spark plug arc generated near the end of the engine's exhaust stroke does not have any practical value.

When an engine has been running and then coasts to a stop while the engine's ignition switch is in the off position, fuel and fuel vapors may accumulate in the engine's exhaust system. When attempting to restart an engine with fuel and/or fuel vapors accumulated in the engine's exhaust system, the mixture of fuel and fuel vapors may be ignited by the spark plug arc that is generated during the engine's exhaust stroke. When this occurs, a loud popping sound may be generated within the engine's exhaust system.

FIGS. 1 and 2 illustrate a typical prior art small 4-stroke internal combustion engine with overhead valve (OHV) configuration. A pull rope 4 is used to rotate a manual starter 8, causing rotation of a crankshaft 12. An intake valve 16 controls the flow of fuel between a port 17 and a combustion chamber 20. Valve 16 is of the usual poppet type having a head 24 that is alternately seated and unseated on a seat 28. The valve 16 is operated by a valve operating mechanism 32 that moves the valve 16 between its closed position and its open position. Mechanism 32 includes a valve stem 36 connected to the valve head 24. Valve stem 36 is confined to axial movement in a valve guide 40 typically pressed into an engine cylinder head 42 on an OHV engine or in the engine housing on side valve engines. The exhaust valve (not shown) is operated by a valve mechanism that is similar to mechanism 32.

Valve operating mechanism 32 also includes a return spring 48, a cam follower 56 and a cam 60. Cam follower 56 may alternately engage and disengage both the cam 60 disposed on a cam shaft 64 and a compression release assembly (not shown). The cam 60 includes a lobe portion

68. U.S. Pat. No. 5,150,674 issued to Gracyalny and assigned to Briggs & Stratton Corporation, the assignee of the present invention, discloses such a compression release assembly. U.S. Pat. No. 5,150,674 is incorporated by reference herein. A push rod 84 is moved by the cam follower 56 axially toward a rocker arm 76, the rocker arm 76 having a first portion 77 and a second portion 78. As the push rod 84 moves the first portion 77, the rocker arm 76 pivots about a rocker fulcrum 80, allowing the second portion 78 to in turn move the valve stem 36.

Spring 48 extends axially about valve stem 36 and is retained in place by a spring retainer 49. The spring force of spring 48 biases valve 16 to its seated or closed position. The spring force of spring 48 is opposed by the axial movement of the cam follower 56 that moves the valve 16 to its unseated or open position.

A variety of means have been considered in attempting to prevent spark plug arcing from occurring during a small engine's exhaust stroke. Typically, such methodologies require sophisticated and expensive electronic circuitry to determine the current stroke of the engine in order to blank the appropriate spark plug arc. Due to the relative degree of sophistication and associated high costs, previous methodologies are not cost effective for use on a low-cost internal combustion engine.

SUMMARY OF THE INVENTION

The present invention comprises a four-stroke cycle, spark ignition (SI), internal combustion engine that suppresses an electrical spark in the exhaust stroke of a small internal combustion engine. In an internal combustion engine having a compression stroke, an exhaust stroke and an ignition primary winding, the internal combustion engine comprises valve operating assemblies that operate an intake and an exhaust valve. Each valve operating assembly may include a cam, a cam shaft, a cam follower, a rocker arm, a rocker fulcrum, a return spring, and a push rod, depending on the valve layout. An automatic compression release assembly may also be provided for the exhaust valve.

A switch is electrically interconnected with the primary winding, mechanically interconnected with the cam shaft and actuated in timed relation to cam shaft rotation such that during the exhaust stroke, the primary winding may be electrically connected to ground. In the alternative, the switch may also be positioned to electrically connect the primary winding to an energy storage device during the exhaust stroke or to electrically connect the primary winding to a load. The switch may comprise two electrically conductive contacts, which may be positioned to be in electrical contact with each other when the unnecessary spark is suppressed. The energy storage device may be a capacitor or a battery, and may be used to drive a variety of loads such as a light emitting diode, a light, or a controller. Alternatively, the primary winding could be electronically connected such that it directly drives a load during the exhaust cycle. A second switch may be positioned to be actuated by the first switch to either electrically connect the primary winding to ground or to transfer the energy from the primary winding to the energy storage device.

Accordingly, a principal feature and advantage of the invention is to provide an apparatus for blanking an unnecessary spark during the exhaust stroke of an internal combustion engine.

It is another feature and advantage of the invention to substantially eliminate the prefire condition of an internal combustion engine caused by the unnecessary spark.

It is another feature and advantage of the invention to utilize the energy provided by the unnecessary spark for other functions of the internal combustion engine or the device powered by the engine.

Other features and advantages of the invention are set forth in the following drawings, detailed description and claims.

BRIEF DESCRIPTION OF THE DRAWINGS

FIG. 1 is a side view of a typical prior art overhead valve (OHV) spark-type internal combustion engine.

FIG. 2 is a sectional view through line 2—2 of FIG. 1 of a typical prior art four cylinder internal combustion engine.

FIG. 7 is a side view of a disengaged position of a contact member and a push rod of an internal combustion engine.

FIG. 8 is a side view of an engaged position of contact member and a push rod of an internal combustion engine.

FIG. 9 is a side view of an engaged position of an automatic compression release and a cam follower of an internal combustion engine.

FIG. 10 is a side view of a disengaged position of a contact member and a tab of an automatic compression release assembly of an internal combustion engine.

FIG. 11 is a side view of an engaged position of a contact member and a tab of an automatic compression release assembly of an internal combustion engine.

FIG. 12 is a block diagram of an energy storage device positioned to drive a load.

FIG. 13 is a block diagram depicting a load that may be directly driven by the primary winding energy.

Figure 3:
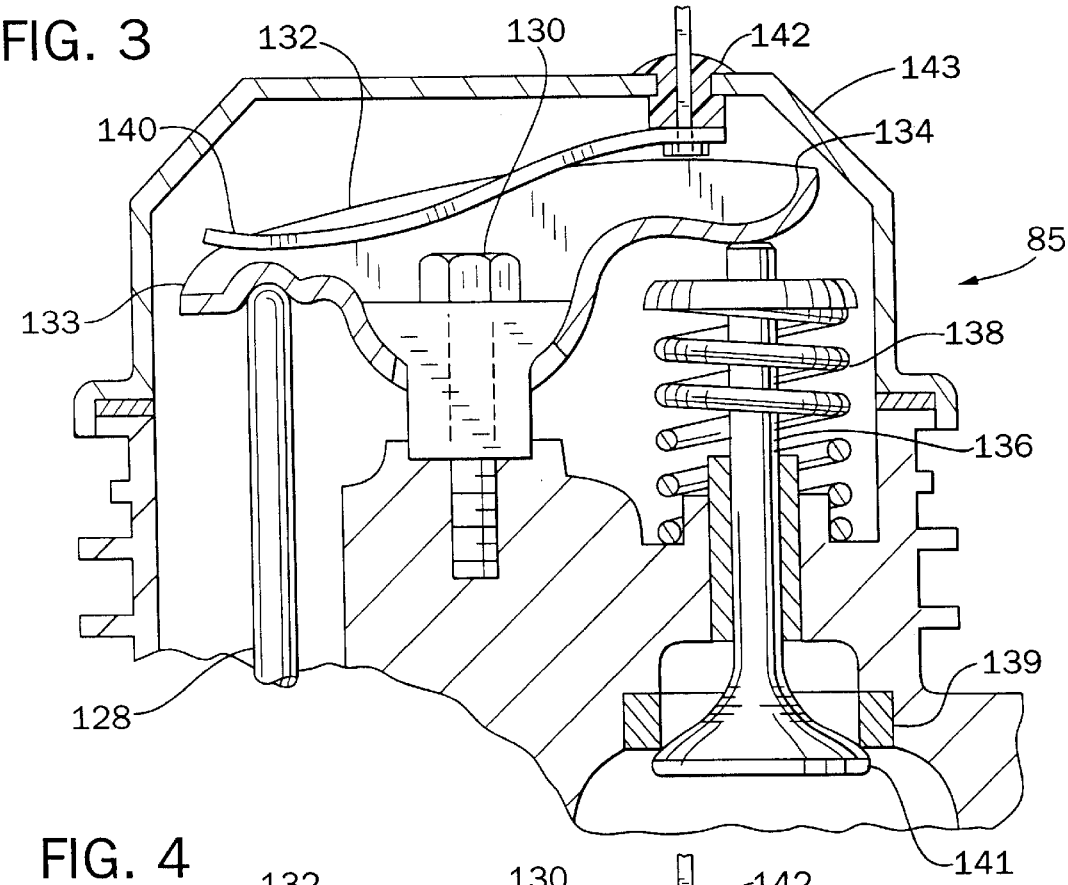
FIG. 3 is a side view of a disengaged position of a contact member and a rocker arm of an internal combustion engine.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Figure 4:
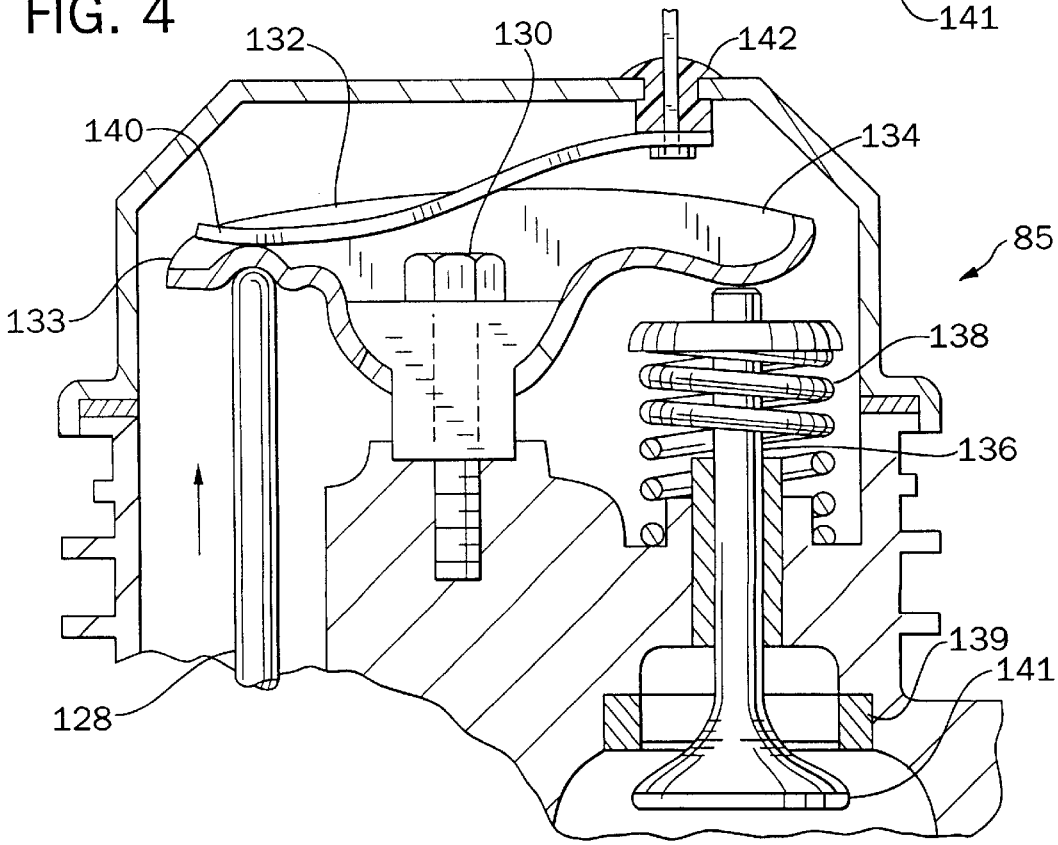
FIG. 4 is a side view of an engaged position of a contact member and a first portion of a rocker arm of an internal combustion engine.

FIGS. 3 and 4 illustrate an embodiment to suppress an ignition spark during the exhaust stroke of an internal combustion engine. FIG. 3 is a side view of a disengaged position of a contact member and a rocker arm of an internal combustion engine. A valve operating assembly 85 includes a push rod 128, a rocker arm 132 having a first portion 133 and a second portion 134, a valve stem 136, a return spring 138, a valve seat 139 and a valve 141. As illustrated in FIG. 3, push rod 128 is positioned such that the push rod 128 may move axially toward the rocker arm 132 as a cam (FIG. 5) operates the push rod 128. A contact 140 is positioned adjacent to the rocker arm 132, but not in electrical contact with the rocker arm 132. The push rod 128 is positioned to engage the rocker arm 132 that pivots about the rocker fulcrum 130. The first portion 133 of the rocker arm 132 is positioned to engage push rod 128 at a point of contact, and the second portion 134 of the rocker arm 132 is positioned to engage the valve stem 136 at a point of contact. The push rod 128 is positioned to move axially toward the rocker arm 132. As the rocker arm 132 pivots about the rocker fulcrum 130 during valve opening, the second portion 134 is positioned to move toward valve stem 136. The movement of the second portion 134 during valve opening causes the return spring 138 to compress about the valve stem 136.

FIG. 4 is a side view of an engaged position of a contact member and a first portion of a rocker arm of an internal combustion engine. In FIG. 4, the push rod 128 moves axially toward the rocker arm 132 as the cam shaft (see e.g. FIG. 7) rotates. As the push rod 128 moves, the push rod 128 engages the rocker arm 132, which pivots about the rocker fulcrum 130, which in turn moves the valve stem 136. The movement of rocker arm 132 causes valve head 141 to move axially away from valve seat 139 to its unseated or open position. As the push rod 128 moves toward the rocker arm 132, the rocker arm 132 engages an electrically conductive contact member 140, extending through an electrically insulated fitting 142, located in the valve cover 143. The contact member 140 is electrically connected to the primary winding of the engine ignition coil. When the electrically conductive metallic rocker arm 132 is electrically connected to the contact member 140, the ignition spark is inhibited. Thus, the contact member becomes mechanically interconnected with the cam shaft, through the rocker arm and other components of the valve operating assembly during an exhaust stroke of the engine.

Figure 5:
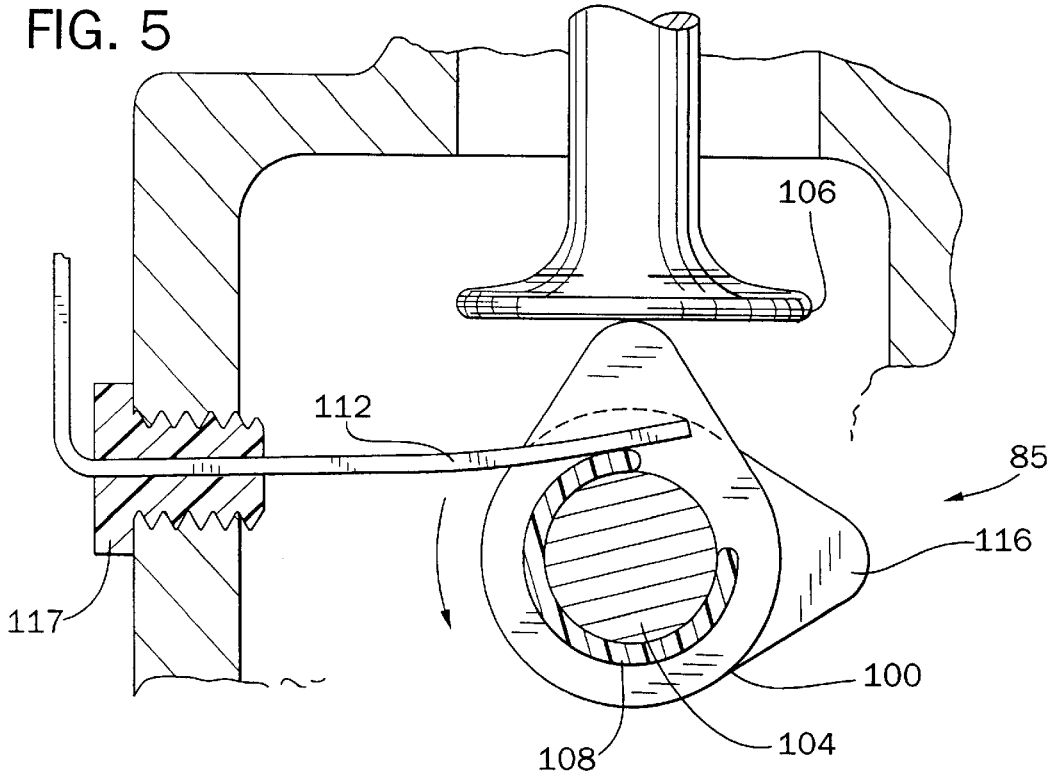
FIG. 5 is a side view of a disengaged position of contact member and a cam shaft of an internal combustion engine.
Figure 6:
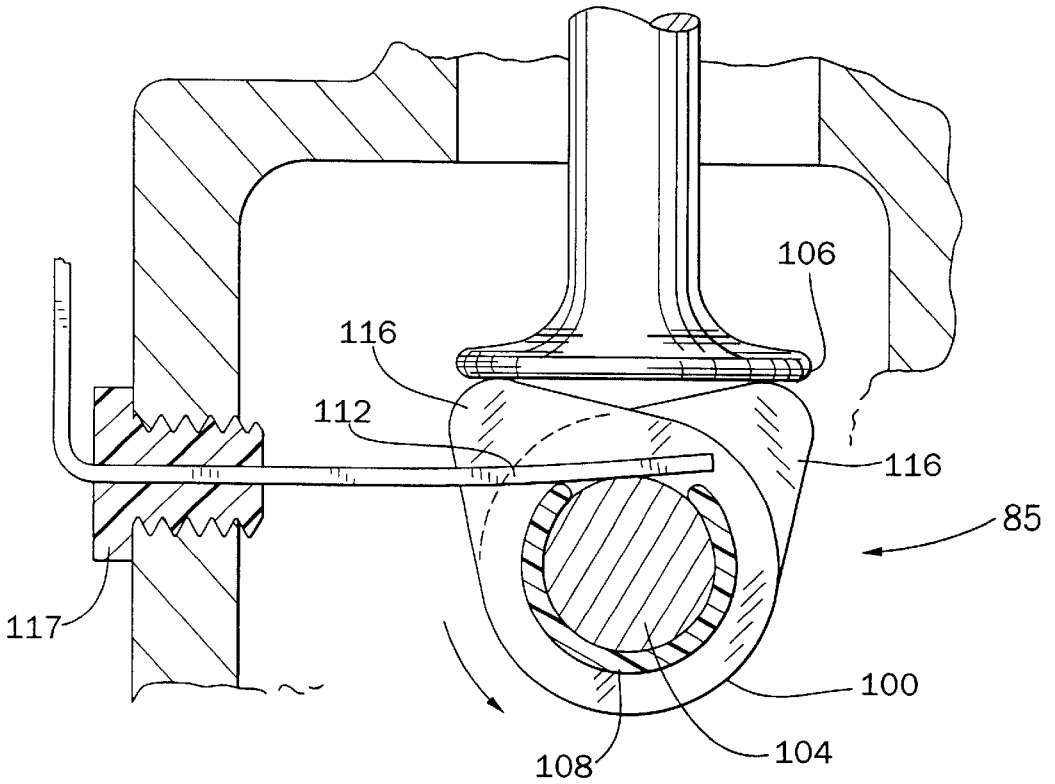
FIG. 6 is a side view of an engaged position of a contact member and a cam shaft of an internal combustion engine.

FIGS. 5 and 6 illustrate an embodiment of the present invention to suppress an ignition spark during the exhaust stroke of an internal combustion engine. FIG. 5 is a side view of a disengaged position of contact member and a cam shaft of an internal combustion engine. FIG. 6 is a side view of an engaged position of a contact member and a cam shaft of an internal combustion engine. In FIGS. 5 and 6, the valve operating assembly 85 is comprised of a cam 100, a cam shaft 104, a push rod (see e.g. FIG. 7), a cam follower 106, and a contact member 112. The valve operating assembly 85 may also be in an overhead cam or side valve configuration. The cam 100, having a lobe portion 116, rotates with the cam shaft 104. An insulator 108 is disposed partially around the cam shaft 104, allowing a portion of the surface of the cam shaft 104 to be exposed. The cam shaft 104 is typically made of an electrically conductive material, such as steel. The contact member 112 extends through an insulated fitting 117 and is in physical contact with the insulator 108 about the cam 100 during some portions of the engine cycle. The contact member 112 is electrically connected to the primary winding of the engine ignition coil.

As the cam shaft 104 rotates, the contact member 112 engages either insulator 108 or cam shaft 104. When the contact member 112 engages the cam shaft 104 at the appropriate time during the exhaust stroke, an electrical connection is completed between the contact member 112, the cam shaft 104, and ultimately back to the ignition coils ground. The electrical connection between the contact member 112 and the primary winding prevents an ignition spark from being generated across the coil's secondary winding, thereby preventing a spark from being generated by the spark plug in the combustion chamber.

Another embodiment to suppress an ignition spark during the exhaust stroke of an internal combustion engine is illustrated in FIGS. 7 and 8. FIG. 7 is a side view of a disengaged position of a contact member and an insulator of an internal combustion engine. FIG. 8 is a side view of an engaged position of contact member and a push rod of an internal combustion engine. The valve operating assembly 85 is comprised of a push rod 168, a cam 172, a cam shaft 180, and a cam follower 182. FIG. 7 illustrates the contact member 160 abutting insulating material 164 partially disposed around the push rod 168. The contact member 160 extends through an electrically insulated fitting 162 and is electrically connected to the primary winding of the ignition coil. During the engine exhaust stroke, contact member 160 is mechanically interconnected with cam shaft 180 through push rod 180. One end of the push rod 168 contacts the cam follower 182. The cam 172, having a lobe portion 176, rotates with the cam shaft 180. As the cam 172 rotates with the cam shaft 180, the lobe portion 176 of the cam 172 engages the cam follower 182 and moves the push rod 168 axially toward the rocker arm. As the push rod 168 moves a predetermined distance, the push rod 168 engages the contact member 160, thereby causing an electrical connection between the push rod 168 and the contact member 160, ultimately grounding the primary winding of the ignition coil and thereby inhibiting a spark from being generated by the ignition coil.

Another embodiment to suppress an ignition spark during the exhaust stroke of an internal combustion engine is illustrated in FIGS. 9–11. In FIGS. 9–11, the valve operating assembly 85 comprises a cam 220, a cam shaft 228, a cam follower 240, and an automatic compression release assembly 200. FIG. 9 is a side view of the invention wherein an automatic compression release is in an engaged position. One advantage of the system shown in FIGS. 9 through 11 is that the spark-blanking switch only operates when tab 240 of the automatic compression release is in the engine starting position. This helps prevent switch wear during engine running.

In FIG. 9, the automatic compression release mechanism (ACR) 200 partially relieves compression in a combustion chamber during engine starting to reduce the rope pull force necessary during engine starting. The ACR 200 includes a flyweight 202, a tab 204, a pivot pin 205 and a yoke 206. The compression release assembly is centrifugally responsive so that it releases combustion chamber pressure only at relatively low engine cranking speeds. U.S. Pat. No. 5,150,674 issued to Gracyalny and assigned to Briggs & Stratton Corporation, the assignee of the present invention, discloses a similar compression release assembly and is incorporated by reference herein. Other types of ACR mechanisms could be used.

When the compression release mechanism responds to centrifugal force, the flyweight 202 moves radially away from cam shaft 228. The tab 204 moves away from the cam follower 240, as yoke 206 pivots about pivot pin 205. The compression release assembly 200 disengages from the valve, enabling the valve bias including the spring to keep the valve closed until the intake and exhaust cam followers engage the respective cams.

At low engine speeds, tab 204 engages an exhaust valve cam follower 240 to partially open an exhaust valve. Tab 204 also actuates a switch at the appropriate time by electrically connecting a first contact 232 with a second contact 236, which thereby prevents an ignition spark from being generated during the engine's exhaust stroke during engine start-up (see FIG. 11). The switch may be a mechanical switch requiring physical contact, or a non-contact switch that senses the opening of the exhaust valve when the exhaust valve is open or not entirely closed. The switch may be composed of a spring that is in contact with the exhaust valve if the exhaust valve is not completely closed.

FIGS. 10 and 11 illustrate the disengaged and engaged (ungrounded and grounded) switch positions, respectively, of the embodiment depicted in FIG. 9. FIG. 10 is a side view of a disengaged position of a contact member and a tab of an ACR of an internal combustion engine. FIG. 11 is a side view of an engaged position of a contact member and a tab of an automatic compression release assembly of an internal combustion engine. The cam 220, having a lobe portion 224, rotates with the cam shaft 228. The first contact 232 and the second contact 236 are positioned adjacent the cam 220. As the cam 220 rotates with the cam shaft 228, the lobe portion 224 engages the cam follower 240 (see FIG. 11). As the lobe portion 224 engages the cam follower 240, the tab 204 of the automatic compression release assembly 200 engages the first contact member 232, pushing the first contact 232 such that electrical contact is made with the second contact member 236. The first contact 232 extends through an electrically insulated fitting 234 and is electrically connected to the primary winding of the engine ignition coil. The second contact member is grounded. When the first contact 232 is electrically connected to the second contact 236, a circuit is completed that grounds the primary winding and therefore prevents an unwanted spark during start-up. At the same time, first contact 232 is mechanically interconnected with cam shaft 228 through the ACR. In an alternate embodiment, the second contact 236 may be eliminated in favor of providing a ground connection via the cam 220 and the tab 204.

In yet an alternate embodiment, a switch activated by the lobe portion 224 on the cam shaft 228 may be used to ground the unnecessary ignition pulses. The switch may include a cantilevered contact element having one end electrically connected to the ignition primary winding, and an intermediate portion electrically contacting the lobe portion 224. In yet an alternate embodiment, the switch may contact the valve tappet 240 instead of the lobe portion 224.

In yet another alternate embodiment, a separate mechanism other than the valve operating assembly may operate the primary grounding switch during the appropriate time to suppress the unwanted ignition sparks. For example, a gear driven off a cam shaft gear could be used to actuate the first switch. In such an embodiment, the first switch would still be mechanically interconnected with the cam shaft through the cam gear and the driven gear.

FIGS. 12 and 13 illustrate alternate methods of preventing the unwanted spark, while still utilizing the energy generated by the ignition coil. Instead of grounding the unwanted ignition pulses, the electrical energy is transferred to an energy storage device 252 (FIG. 12) that in turn may drive a load 256. Switches 258 and 260 allow the energy delivery to be controlled.

It is contemplated that the energy storage device 252 may be a capacitor or a battery. The energy storage device could be used to drive a load, or load 256 could be directly driven by the ignition coil energy through an optional switch 262. See FIG. 13. The load may be a light emitting diode (LED), a light panel, headlights, a controller or another device.

What is claimed is:

1. A four stroke cycle internal combustion engine, each cycle having a compression stroke and an exhaust stroke, and said engine having an ignition primary winding, comprising:

a rotatable cam shaft;

a switch electrically interconnected with the primary winding and mechanically interconnected with said cam shaft, that actuates in timed relation to the rotation of said cam shaft such that at least one of: (a) the primary winding is electrically connected to ground during an exhaust stroke; (b) the primary winding is electrically connected to an energy storage device during an exhaust stroke; and (c) the primary winding is electrically connected to a load.

2. The engine of claim 1, wherein said switch is actuated by establishing an electrical connection with said cam shaft.

3. The engine of claim 1, wherein said engine includes an intake valve, an exhaust valve, and a valve operating assembly that includes said cam shaft and that operates at least one of the intake valve and the exhaust valve, and wherein said switch is actuated by said valve operating assembly.

4. The engine of claim 3, wherein said valve operating assembly further includes an insulator disposed on the cam shaft such that said switch is actuated when said contact member is electrically connected to said cam shaft.

5. The engine of claim 3, wherein said valve operating assembly further includes an automatic compression release assembly, and wherein said switch is actuated by establishing an electrical connection with said automatic compression release assembly.

6. The engine of claim 5, wherein said switch includes a contact member that is electrically connectable to said automatic compression release assembly, said contact member being electrically connected to the primary winding.

7. The engine of claim 6, wherein said switch is positioned to actuate when said contact member is electrically connected to a tab of said automatic compression release assembly.

8. The engine of claim 5, wherein said automatic compression release assembly includes a pivot, a yoke and a tab.

9. The engine of claim 8, wherein said tab of said automatic compression release assembly establishes an electrical connection with a contact member, said contact member being electrically connected to the primary winding.

10. The engine of claim 3, wherein said valve operating assembly further includes a push rod, and wherein said switch is actuated by establishing an electrical connection with said push rod.

11. The engine of claim 10, wherein said switch includes an electrically conductive contact member that is electrically connected to the primary winding, and wherein said valve operating assembly further includes an insulator disposed on the push rod, such that said switch is actuated when said contact member is electrically connected to said push rod.

12. The engine of claim 3, wherein said valve operating assembly further includes a rocker arm, and wherein said switch is actuated by establishing an electrical connection with said rocker arm.

13. The engine of claim 12, wherein said switch has a contact member that is positioned to actuate when said contact member is electrically connected to said rocker arm.

14. The engine of claim 1, further comprising a second switch connected in circuit between said primary winding on the one hand, and at least one of said storage device and said load on the other hand.

15. The engine of claim 14, wherein said engine has a spark plug, and wherein said second switch is connected in circuit upstream of said spark plug such that no spark is produced by said spark plug during the exhaust stroke.

16. The engine of claim 1, wherein said engine includes an exhaust valve, and wherein said switch is actuable when the exhaust valve is at least partially unseated.

17. The engine of claim 1, wherein the energy storage device is a capacitor.

18. The engine of claim 1, wherein the energy storage device is electrically connected to drive an external device.

19. The engine of claim 18, wherein the external device is a light emitting diode.

20. The engine of claim 18, wherein the external device is a headlight.

21. The engine of claim 18, wherein the external device is a controller.

* * * * *